United States Patent [19]

Pressler et al.

[11] 4,122,796

[45] Oct. 31, 1978

[54] ADJUSTABLE PENNANT WARNING OF DOWNED WATER SKIERS

[76] Inventors: Kurt T. Pressler, 9 Canyon View Dr., Orinda, Calif. 94563; Scott Cattell, 5515 Rio Vida La., Sebastapol, Calif. 95472

[21] Appl. No.: 776,790

[22] Filed: Mar. 11, 1977

[51] Int. Cl.[2] ..... A63C 15/00; G08B 5/14

[52] U.S. Cl. ..... 116/132 R; 9/1.1; 116/28 R; 116/173

[58] Field of Search ..... 116/124 R, 132 R, 134, 116/173, 35 R; 114/235 WS; 40/125 H, 125 J

[56] References Cited

U.S. PATENT DOCUMENTS

| | | | |
|---|---|---|---|
| 2,881,543 | 4/1959 | De Rouen | 116/132 R |
| 3,191,898 | 6/1965 | McCullough | 116/28 R |
| 3,315,634 | 4/1967 | Sherrill | 116/132 R |
| 3,479,982 | 11/1969 | Honcharenko | 116/35 R |
| 3,497,980 | 3/1970 | Brown et al. | 116/132 R X |
| 3,520,273 | 7/1970 | Dalfotes | 116/28 R |
| 3,786,778 | 1/1974 | Palmer et al. | 116/132 R |
| 3,982,771 | 9/1976 | Tropeano | 116/35 R |

*Primary Examiner*—Daniel M. Yasich
*Attorney, Agent, or Firm*—Harold D. Messner

[57] ABSTRACT

In order to satisfy safety regulations promulgated by the United States Coast Guard (USCG), the present invention provides a hand-powered, top-action pennant assembly permanently mounted to a stationary portion of a boat, such as a foredeck or the like, for allowing a warning pennant attached to a mast of the assembly to be relocated as required to satisfy U.S.C.G. safety regulations.

2 Claims, 6 Drawing Figures

ADJUSTABLE PENNANT WARNING OF DOWNED WATER SKIERS

SCOPE OF THE INVENTION

The present invention relates to a top action, hand-powered pennant assembly permanently mounted to a stationary portion, such as foredeck, of a tow boat used to transport water skiers or the like over the surface of a body of water, and more particularly to such a pennant assembly that allows a warning pennant attached to a mast to remain semi-permanently attached relative to such stationary boat portion in one of two positions:

(i) in an upright position where the mast is perpendicular to the boat's foredeck thereby placing the pennant in a maximum observable position for warning other boaters of a "downed" water skier or the like adjacent to the tow boat; and (ii) in a stowed position wherein the mast and pennant are folded in a reclining position parallel to the same foredeck.

DISCLAIMER

While the descriptions set forth in the Abstract and Scope of the Invention, supra, have been carefully written, the purpose of such statements is to provide a non-legal opinion of the contents of this application only as a searching, scanning and classification mechanism for technical persons. Accordingly, all hereinbefore presented statements are not intended to be used in understanding or otherwise comprehending the principles of the invention hereinafter described in detail and is not, more particularly, to be used in interpreting or in any way limiting the scope or fair interpretation of the claims appended hereto.

BACKGROUND OF THE INVENTION

Today's pleasure and industrial boat owners and users are required to give warning to other boaters of swimmers in the water adjacent to the boat whether for pleasure or commercial purposes. For example, in the case of pleasure boats towing water skiers, the United States Coast Guard (USCG) requires a pennant to be flown from the boat whenever the water skier is submerged in the water adjacent the two boat, say, after he loses his balance and falls during a water skiing maneuver. In that way, other boaters can be warned of the possible dangerous situation existing in the vicinity.

One of the problems of attempting to maintain a warning pennant assembly aboard a tow boat is that the former is only required during a selected phase of boating activities: during water ski towing. Hence, the pennant can be lost or otherwise mislaid during other activities; then when a situation arises wherein the pennant is reuired, it is not available and the USCG's regulations may of necessity be ignored.

While flags and other type of pennants have been flown aboard boats, ships and the like since early times, we are unaware of any prior art devices which allow the pennant and mast themselves to be relocated from a stowed position to an upright warning position by means of a top-action, hand-powered pennant assembly along a rotational arc defining a plane perpendicular to the foredeck of the tow boat which defines two terminal positions: (i) an active position where the pennant has maximum viewability and (ii) a stowed position closely adjacent to the foredeck.

OBJECT OF THE INVENTION

An object of the present invention is to provide a novel pennant mounting assembly for warning boaters in the general vicinity of downed skiers in which at least the mast carrying the warning pennant remains permanently linked to the stationary portion of the boat during all regular boating activities of the latter, yet can be stowed so as to not interfer with or hamper such operations unduly.

Other objects and advantages of this invention will become more apparent from the following description of an embodiment thereof in which the following drawings form an important appendage thereto.

DETAILED DESCRIPTION OF THE INVENTION

Figure 1:
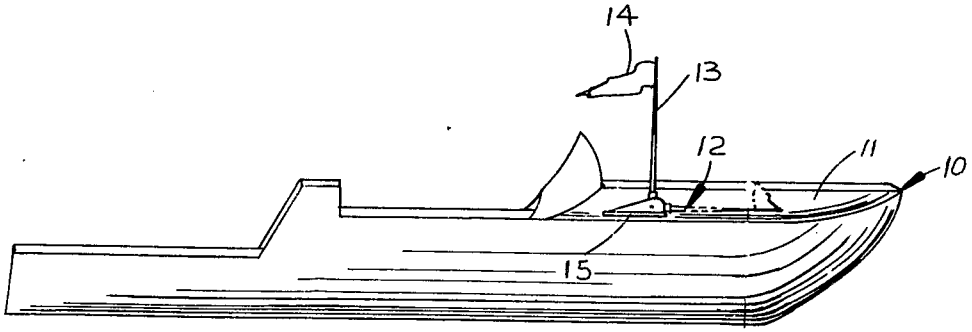
FIG. 1 is a side elevation of a pleasure boat of a type useful in towing water skiers or the like in which a topaction, hand-powered pennant assembly of the present invention is shown, such assembly supporting a mast carrying pennant in two positions: (i) an upright position as shown and (ii) a stowed position as shown in phantom line.

Please refer to the drawings and in particular to FIG. 1 which illustrates a power boat 10 having a foredeck 11 to which pennant assembly 12 of the present invention is attached. In FIG. 1, mast 13 and pennant 14 of the assembly 12 are carried in an upright position whereby the pennant 14 has maximum viewability so as to signify to onlookers that a water skier is "downed" in the vicinity of the power boat 10.

Pennant assembly 12 includes a tear-drop shaped base 15 adapted to be fixedly mounted, as by screws to the foredeck 11. Strategy of position: it must be within the reach of the operator or passenger so as to be easily rotatable in a plane perpendicular to the foredeck 11, say along arc C of FIG. 2. Assembly 12 is enlarged at one end to accomodate mast 13 as well as constructed with swivable elements as described below to allow its rotational movement about the base 15. Consequently, the mast 13 and pennant 14 as explained below can be positioned in either of one or two positions: (i) in an upright position as shown in solid line in FIG. 1 or (ii) in a stowed position wherein it reclines parallel to the foredeck 11 as shown in phantom line.

Figure 2:
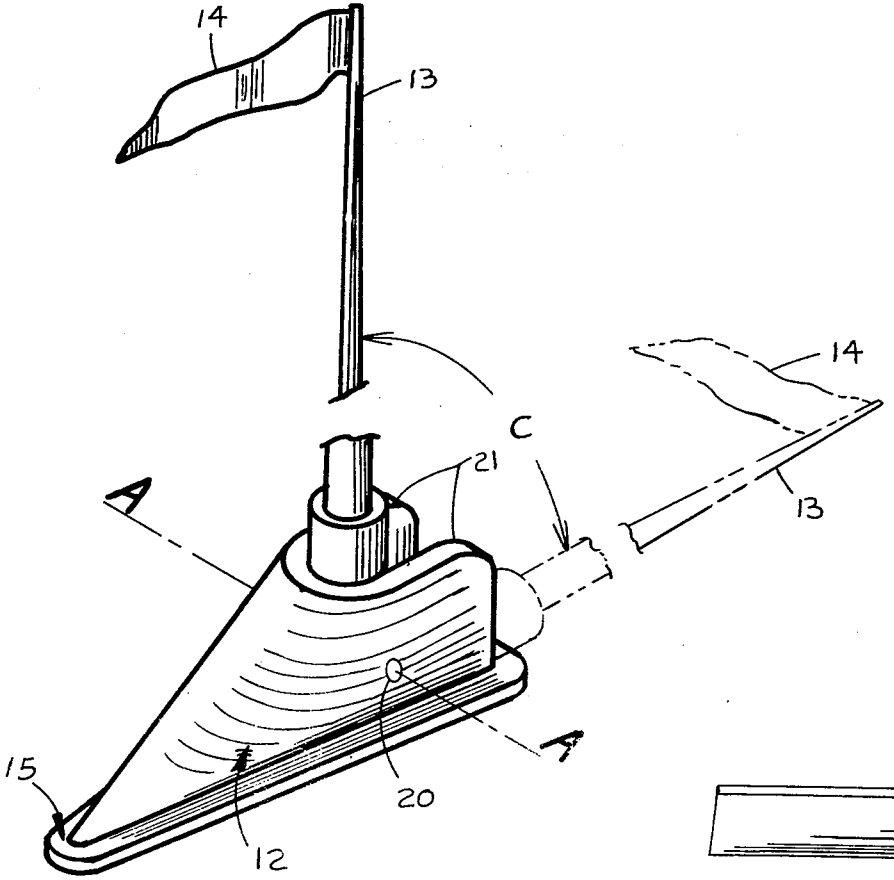
FIG. 2 is an enlarged perspective of the pennant, mast and assembly of FIG. 1.

FIG. 2 illustrates mast 13 and pennant 14 and the two operational positions (i) and (ii), supra, in more detail.

In FIG. 2, rotational working axis A—A of the mast 13 is seen to be coincident with the pivot pin 20 of the base 15. While pin 20 is slidably connected at its end to sidewall 21 of the base 15, its central area is in fixed contact with horizontal bore 23 (FIG. 3) defined by working axis A—A of retaining cup 22. Consequently, pennant 14 can be easily relocated—by hand-action—from upright position (i), supra, to stowed position (ii), supra, with minimum effort, say over the arc C defining a plane on thogonol to foredeck 11.

Figure 3:
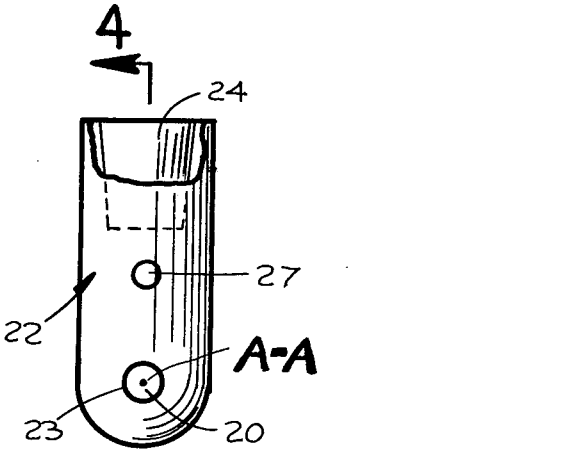
FIGS. 3–6 are detailed drawings of various aspects and elements of the pennant assembly of FIG. 2.
Figure 4:
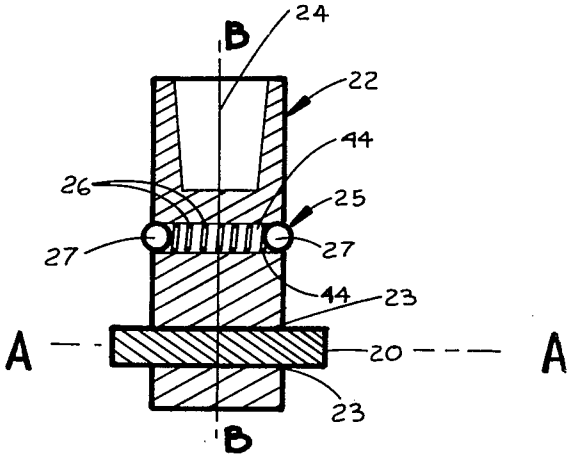

FIGS. 3 and 4 illustrate retainer cup 22 in more detail.

In general, retainer cup 22 performs a swivel movement about axis A—A defined by pivot pin 20. As previously mentioned, the pivot pin 20 is retained within the horizontal bore 23 of cup 22 by means of a press fit. Note that retainer cup 22 includes slotted end cavity 24 (FIG. 4) whose axis of symmetry B—B is normal to axis A—A of the horizontal bore 23. Slotted end cavity 24 releasably receives the mast 13 of FIG. 2 carrying pennant 4.

Between horizontal bore 23 and cavity 24, a latching assembly 25 (FIG. 4) is provided, such assembly including a spring 26 slidably located within horizontal bore 44 parallel to bore 23. At opposed ends of spring 26 are opposed metallic spheres 27.

Figure 5:
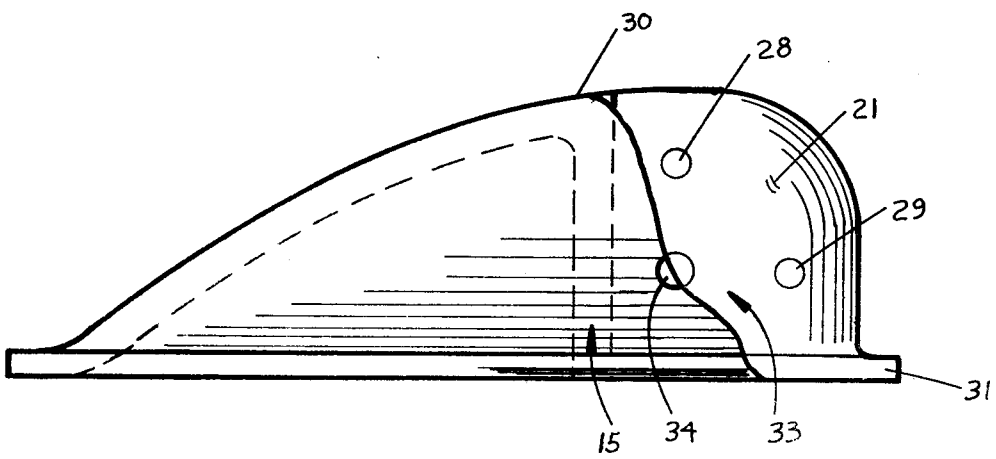

The operation of latching assembly 25 is straight-forward: with additional reference to FIG. 5, the metallic spheres 27 are pushed outwardly into contact with upright walls 21 of base 15 by the action of spring 26. Such spheres 27 are also capable of being semirigidly captured within and held in contact with pairs of travel-limiting recesses 28 and 29, see FIG. 5. As shown in FIG. 5, the pairs of recesses 28 and 29 are formed within sidewall 21 of base 15, with each pair being horizontally aligned parallel to each other and contiguous with pivot pin 20 (FIG. 4). The amount of pressure exerted by spring 26 in operations is sufficient to position spheres 27 within recesses 28 or 29 with sufficient force to define travel-limiting terminal positions to limit the rotational arc of the mast 13 retained within the cup 22, i.e., either position (i) or (ii), supra of FIG. 2. Note in FIG. 4 that in position (i) axis B—B of symmetry of end cavity 24 is vertical; while in position (ii) it is horizontal.

Figure 6:
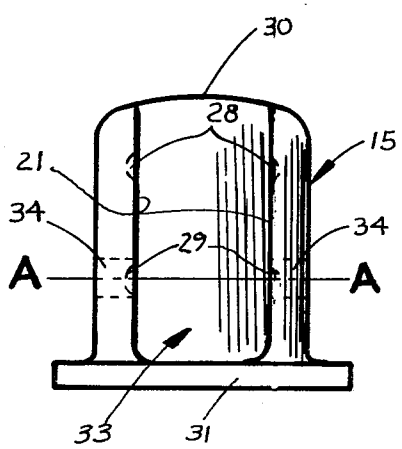

FIGS. 5 and 6 shows base 15 in more detail.

As shown, the base 15 includes an outer housing 30 extending above a flat plate 31. Housing 30 is slotted to form cavity 33, including the upright sidewalls 21 on which pairs of recesses 28, 29 previously mentioned, are formed.

It should be recalled at this time that pivot pin 20 is located therein within openings 34 of outer housing 30.

Again, returning to FIG. 5, note the position of the pairs of recesses 28 and 29. While the pair of recesses 28 are located vertically above openings 34 of housing 30 the remaining pair of recesses 29 are horizontally aligned with respect to the openings 34. Thus, the pair of recesses 28 retain the cup 22 of FIGS. 3 and 4 in an upright position while the pair of recesses 29 "capture" the cup in a stowed position parallel to the flat plate 31. The diameter of the cup 22 is also constructed to be small enough to be rotatable within the cavity 33, but with sufficient friction being provided by locking assembly 25 wherein the pair of recesses 28 and 29 as hereinbefore described are utilized.

Of course, the present invention may be embodied in other specific forms without departing from the spirit of the instant disclosure of central attributes of the invention, and accordingly, references should be had to the claims appended hereto rather than the foregoing description as indicated in the scope of the invention.

What is claimed is:

1. Warning pennant and support means for warning other boats or the like of an immobile water skier downed in water adjacent to a tow boat, comprising:

(a) a mast having a first end fixedly attached to said warning pennant and a second end opposite to said pennant;

(b) a base fixedly attached to a deck or the like of said tow boat but carrying cooperative rotatable cup means for receiving said second end of said mast, and disconnectably swivelable along an arc defined by:

(i) a horizontal flat stowage position wherein said mast and said pennant attached thereto are positioned adjacent to said deck or the like, substantially parallel therewith; and (ii) an upright signal position in which said first end of said mast attached thereto is a maximum distance above said deck or the like whereby said pennant is afforded maximum viewability for warning other boats of said downed skier;

(c) said cooperative rotatable cup means also including a cylindrical swivel containing a slot at said one end to receive said mast and fitted with a bore at its opposite end defining an axis substantially normal to that of said slot; pin means fixedly positioned within said bore of said swivel but having ends extending there-beyond and rotatably attaching to upright extending walls of said base; and associated locking means located intermediate of said pin means and said bore for receiving said mast;

(d) said associated locking means includes first and second element means carried on said base and said rotatable cylindrical swivel respectively for releasably securing said base and swivel with respect to each other in stowage position (i) or signal position (ii);

(e) said first element means of said associated locking means includes a central opening within said cylindrical swivel, a compression spring positioned within said opening, and tensionable metallic spheres carried at opposite ends of said spring in sliding contact with upright walls of said base, said second element means including spaced recess means provided in upright walls of said base.

2. Warning pennant and support means of claim 1 in which said second element means of said associated locking means includes said recess mean being first and second pairs of recesses in said upright walls of said base, each pair being horizontally aligned substantially parallel to said axis of said pin means but defining a plane passing therethrough normal to that of said other pairs of recesses whereby said tensioned metallic spheres can be suquentially recessed therein whereby said positions (i) and (ii) are defined.

* * * * *